United States Patent [19]

Leingang

[11] 4,307,837

[45] Dec. 29, 1981

[54] ADJUSTABLE SPRING CLIP

[75] Inventor: Charles J. Leingang, Erie, Pa.

[73] Assignee: Lord Corporation, Erie, Pa.

[21] Appl. No.: 159,406

[22] Filed: Jun. 13, 1980

[51] Int. Cl.[3] ..... E01B 9/62; E01B 9/30; E01B 9/46

[52] U.S. Cl. ..... 238/282; 238/287; 238/310; 238/349

[58] Field of Search ..... 238/349, 214, 287, 304, 238/338

[56] References Cited

U.S. PATENT DOCUMENTS

| | | | |
|---|---|---|---|
| 3,576,293 | 4/1971 | Landis | 238/287 |
| 3,784,097 | 1/1974 | Landis | 238/310 |
| 3,858,804 | 1/1975 | Hixson | 238/264 |
| 3,910,493 | 10/1975 | Wood | 238/349 |
| 4,047,663 | 9/1977 | Reynolds et al. | 238/304 |
| 4,062,490 | 12/1977 | Hixson | 238/338 |

*Primary Examiner*—Richard A. Bertsch
*Attorney, Agent, or Firm*—Thomas L. Kautz

[57] ABSTRACT

A laterally adjustable rail clip fastening means is provided by the present invention for securing a resilient rail clip such as a Pandrol clip to a direct fixation rail mounting assembly, and, in turn, into engagement with a rail. The rail clip fastening means includes a pair of U-shaped sections which are laterally moveable along the top plate of the rail mounting assembly on opposite sides of the rail, and are formed to receive and securely hold a resilient rail clip in position against the rail.

9 Claims, 3 Drawing Figures

ADJUSTABLE SPRING CLIP

FIELD OF THE INVENTION

This invention relates to the area of rail securing means, and, more particularly, to a laterally adjustable attachment bracket operable to secure a resilient clip such as a Pandrol clip in position against the rail.

BACKGROUND OF THE INVENTION

The increasing depletion of world wide energy reserves has prompted a renewed interest and emphasis on developing efficient, high speed railway systems for rapid transit and freight shipment. One phase of research and development in this area has been directed toward devising a rail mounting system which would minimize routine maintenance while providing improved vibration isolation, noise reduction and electrical insulation. In many of the more modern rail systems in the United States, particularly for rapid transit, the rails are mounted directly to concrete supporting structures. The disadvantages of wooden ties or wooden ties embedded in concrete are well known. Replacement of wooden ties embedded in concrete is difficult and time consuming, and in subway systems for example, the additional vertical height required to accommodate the thickness of wooden ties results in added expense for tunnel construction.

While concrete ties generally involve less maintenance and last longer than wooden ties, so-called direct fixation systems for mounting the rails to concrete supporting structures must provide means to absorb the impact between the rail and concrete, to avoid damage to the concrete and provide energy absorption to dampen vibrations and attenuate noise. One of the most common direct fixation rail mounting systems presently in use includes a base assembly consisting of a layer of resilient energy absorbing elastomer disposed between and attaching to a base plate mounted to the concrete and a top plate which supports the rail. Such base assemblies have proved to be reasonably effective in minimizing deterioration of the concrete support structure, and reducing vibration and noise transmission to the railway cars and surrounding areas.

However, it has been found that even where the best installation procedures are used, some degree of lateral adjustment must be included in such base assembly designs to assure that the proper gauge is maintained between rails. This is particularly important in areas where the concrete supporting structures are susceptible to sinking, earthquakes or other causes of shifting. U.S. Pat. Nos. 4,062,490 and 3,858,804 to Hixson, for example, disclose base assembly structures in which the position of the rail may be laterally adjusted at the point of anchorage of the base assembly to the concrete. Threaded bolts are embedded in the concrete on opposite sides of the rail, and extend upwardly through corresponding elongated slots formed in the base plate of the base assembly. Fixed brackets or clips attaching to the top plate contact the rail and hold it securely to the base assembly. The entire base assembly including the rail is thus laterally moveable along the elongated slots and secured in the desired position with nuts tightened on to the threaded anchorage bolts.

An alternative approach is found in U.S. Pat. Nos. 3,576,293 and 3,784,097 to Landis in which the base assembly is held in a fixed position relative to the concrete supporting structure, and the brackets or clips which secure the rail are laterally adjustable along the top plate of the base assembly. As in the Hixson disclosures, threaded bolts and nuts are utilized by the Landis systems at the point of anchorage to the concrete and at the point of attachment of the rail to the top plate of the base assembly.

A problem associated with the systems of both Hixson and Landis is that over a period of time the repeated pounding of the rails against the concrete may cause loosening of the threaded bolt-nut attachments both at the anchorage points and at the rail. Due to the lateral adjustment capability in each of the prior art designs mentioned above, loosening of such attachments could result in lateral movement of the rails even in continuously welded track. This can be particularly dangerous in curves where lateral forces tending to urge the rails apart are most prevalent. Thus, continuous maintenance programs are required with such prior art systems to assure that all bolted connections remain tight. In addition, each of the patents cited above include at least one threaded bolt which extends upwardly from the concrete supporting structure and/or at the point of attachment of a bracket or clip to the rail such that the threads are exposed to the weather. As time passes, oxidation and other deterioration of the threads could present maintenance problems in loosening such attachments for lateral adjustment of the rail, or in simply tightening the nuts to the bolts as they become loosened.

In an effort to avoid the potentially substantial costs required for proper maintenance of the systems described above, resilient, one-piece metal clips including so-called Pandrol clips have been utilized as a durable, relatively maintenance-free alternative. See U.S. Pat. No. 3,910,493. The Pandrol rail clip for example, is a resilient metal bar which is bent or formed in a curved shape such that one section contacts the flange of a rail and a second section is secured to the top plate of the base assembly by some form of attachment means. Once in place, the Pandrol clip needs no adjustment, tightening or other form of maintenance unless a failure should occur requiring replacement.

At least one prior art U.S. Pat. No. 4,047,663 to Reynolds et al, has recognized the advantage of using Pandrol clips in combination with the general configuration of standard base assemblies now commonly in use as discussed above. The Reynolds et al direct rail fixation system utilizes eccentrics at the point of anchorage between the base assembly and concrete supporting structure to provide lateral adjustment of the rail. The anchor bolt extending through the eccentric is inserted into a correspondingly threaded sleeve embedded in the concrete. The top plate of the base assembly is formed with generally circular notches or grooves to receive the Pandrol clip and lock it firmly into position against the rail. A disadvantage of this configuration, however, is the same as that described above in connection with the Hixson systems. If the eccentric anchorage connection should loosen after a period of time, the entire base assembly would be susceptible to shifting in response to lateral forces.

SUMMARY OF THE INVENTION

The present invention overcomes the difficulties in the prior art systems, particularly in the Hixson and Landis configurations, by providing an attachment bracket which is formed to firmly hold a Pandrol clip or similar clip in position to secure a rail and is laterally adjustable along the top plate of the base assembly within given tolerances. Anchorage of the base assembly herein is preferably accomplished by inserting a threaded bolt through a bore in the base assembly and then into a correspondingly threaded sleeve embedded in the concrete supporting structure. Unlike the prior art systems of Hixson and Landis, no threads are exposed to the elements where they could become rusted and make tightening or loosening difficult.

In addition, maintenance requirements of the subject invention are considerably less than with existing systems. The bolt-nut attachment at the rail, found in the Hixson and Landis systems, is completely eliminated. Moreover, the attachment at the point of anchorage of the base assembly to the concrete is not as critical as in the Reynolds et al disclosure. Should the anchorage bolt loosen slightly in the inventive system herein, the base assembly would still be held in place laterally as discussed in detail below. Of course increased vibration of the base assembly would occur, but there would be limited lateral movement, if any. In contrast, the Reynolds et al configuration could permit lateral movement of the entire base assembly and rail, in addition to increased vibration, should the eccentric loosen enough to rotate. Although loosening of the base plate from the concrete supporting structure results in increased vibration and noise, the primary danger of spreading of the gauge between rails is avoided by the subject invention.

Therefore it is an object of this invention to provide a laterally adjustable bracket for securing a Pandrol clip or similar clip to a rail in a direct fixation rail mounting system.

It is another object of the present invention to provide a laterally adjustable bracket for securing a Pandrol or similar rail clip, to be used in combination with a direct fixation rail mounting system having non-adjustable fixed anchorage means to the underlying support structure.

It is a further object of the subject invention to provide a laterally adjustable bracket for securing a Pandrol or similar rail clip to a rail, which is capable of remaining in position adjacent the rail to resist lateral movement thereof independently of the rail clip.

DESCRIPTION OF THE DRAWINGS

Objects in addition to the foregoing will become apparent upon consideration of the following description taken in conjunction with the accompanying drawings wherein.

DETAILED DESCRIPTION OF THE INVENTION

Figure 1:
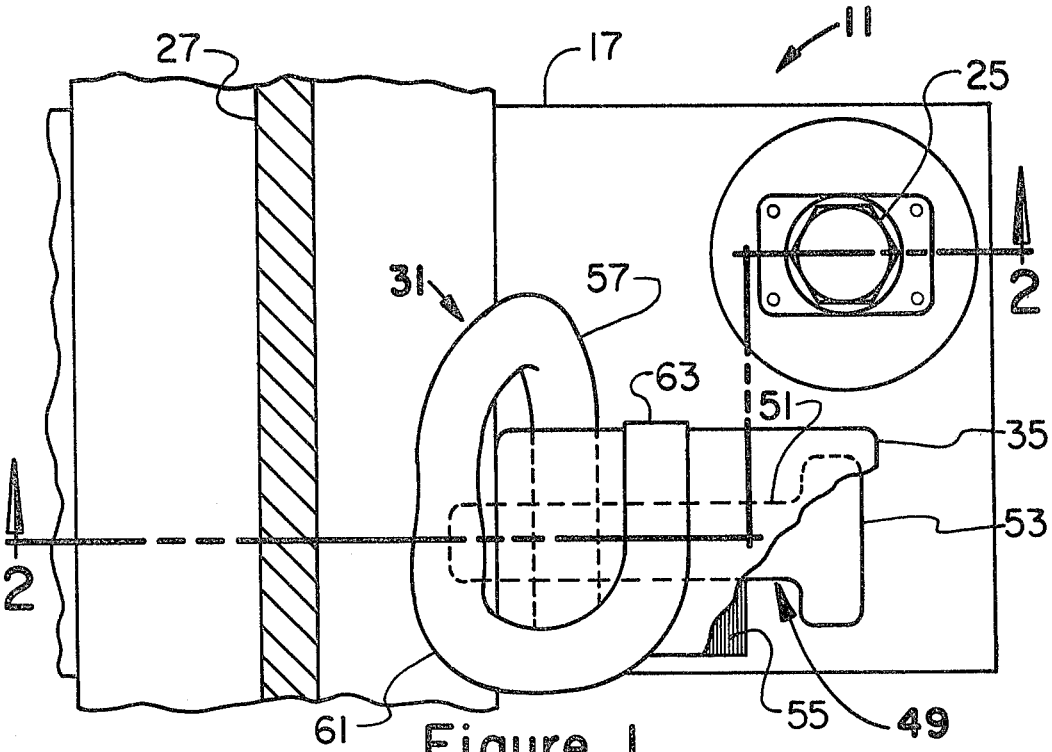
FIG. 1 is a partial top view of a direct fixation base assembly including the fastening means of the present invention.
Figure 2:
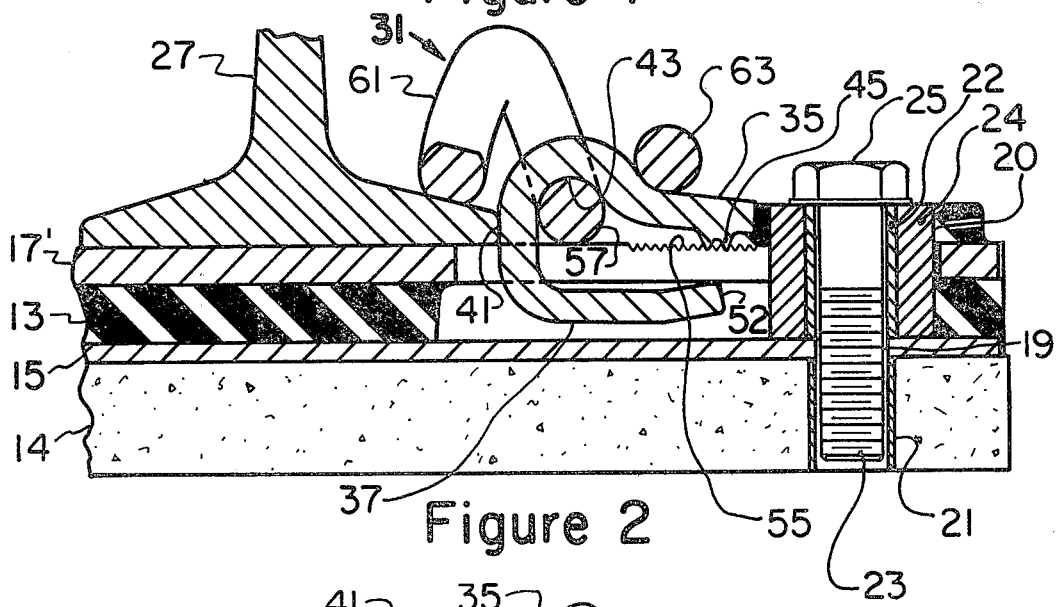
FIG. 2 is a partial cross-sectional view of a direct fixation base assembly showing the attachment of the inventive fastening means herein to a Pandrol clip.

Referring now to the drawings, and in particular to FIGS. 1 and 2, a direct fixation base assembly is shown and labelled generally with the reference 11. It will be observed that FIG. 1 is a view of one side of the base assembly 11 including a fastening means of the present invention which is discussed in detail below. It should be understood that the other side of base assembly 11 is essentially identical and the following discussion is equally applicable to the structure and operation of that portion of the base assembly 11 not shown. A suitable support structure, preferably a precast or cast-in-place concrete support 14, receives and supports base assembly 11 on the track bed. The base assembly 11 includes a layer of resilient elastomeric material 13 disposed between and attaching to a base plate 15 and a top plate 17. The elastomer layer 13 may be secured to plates 15 and 17 by vulcanization, adhesive coatings or any other suitable means. A bore 19 is drilled or punched adjacent the end of base assembly 11 through base plate 15. A larger bore 20 is machined in top plate 17 and elastomer layer 13, concentric with bore 19, and receives a metal sleeve 22 which is press fitted within a plastic jacket 24. The metal sleeve 22 and jacket 24 bear against base plate 15.

Embedded in concrete support 14 in alignment with bore 19 is a correspondingly threaded sleeve 21. A bolt 23, inserted through metal sleeve 22 and bore 19 is tightened into sleeve 21 for securely holding base assembly 11 in a fixed position on support 14. No lateral adjustment of base assembly 11 relative to support 14 is permitted herein and only the head 25 of bolt 23 is exposed to the weather, unlike many of the prior art systems mentioned above. In addition, graphite or any other suitable coating may be applied to the threads of bolt 23 and sleeve 21 to resist oxidation and facilitate tightening and loosening of bolt 23 within sleeve 21.

Figure 3:
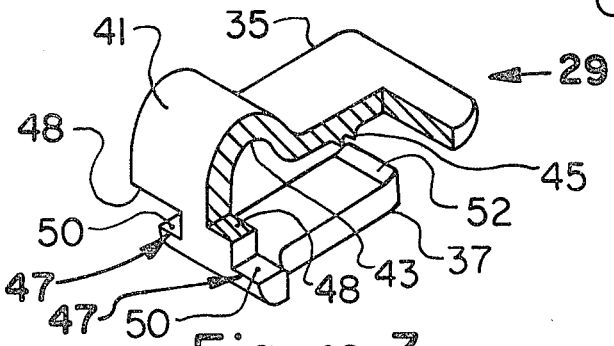
FIG. 3 is a perspective view in partial cross section of the fastening means of the subject invention.

A standard rail 27 is disposed on top plate 17 directly above the elastomer layer 13. As discussed above, the elastomer layer 13 allows base assembly 11 to deflect in response to forces applied to rail 27 which reduces vibration and noise. Rail 27 is firmly held to base assembly 11 by a resilient rail clip such as a Pandrol clip 31, which, in turn, is secured by the unique fastener 29 of the present invention. As shown in FIG. 3, fastener 29 consists of a strip of spring steel which is bent at a point along its length in a modified U-shaped configuration to form an upper leg 35 and a lower leg 37 which are spaced apart and generally parallel at the open end of the U-shape. Adjacent the generally straight closed end 41 of the U-shaped fastener 29, a portion of upper leg 35 is shaped to form a curved section 43. Fastener 29 further includes a plurality of teeth 45 formed in the underside of upper leg 35 which extend downwardly toward lower leg 37. In addition, the closed end 41 of U-shaped fastener 29 includes a pair of rectangular-shaped slots 47 forming upper and lower shoulders 48 and 50 which extend from opposite side edges of fastener 29 toward the middle. Both the teeth 45 and slots 47 may be punched or forged into fastener 29 prior to bending.

Referring now to FIG. 1, a T-shaped keyhole 49, consisting of an elongated stem portion 51 and a head portion 53, is formed in top plate 17 adjacent rail 27. In this embodiment of the subject invention, plate serrations 55, engageable with the teeth 45 in upper leg 35 of fastener 29, are formed in top plate 17 along the stem 51 of keyhole 49. In the alternative, serrations 55 could be located in top plate 17 between head portion 53 of keyhole 49 and the outer edge of base assembly 11, with teeth 45 being correspondingly positioned on fastener 29. The fastener 29 is inserted through head portion 53 of keyhole 49 such that the upper and lower shoulders 48 and 50 of slots 47 straddle top plate 17 allowing fastener 29 to move therealong. The free end 52 of lower leg 37 is beveled upwardly such that the space between legs 35 and 37 at the open end of fastener 29 is less than the thickness of top plate 17. Accordingly, fastener 29 is placed in position against rail 27 by urging legs 35 and 39 apart and striking upper leg 35 with a hammer or the like to move fastener 29 along slot 53. Once the fastener 29 is in position, the teeth 45 of upper leg 35 engage the plate serrations 55 to resist lateral movement. If desired, the upper leg teeth 45 may be tapered in a direction away from rail 27, with the plate serrations 55 being tapered in the opposite direction, to provide added resistance to lateral movement of fastener 29.

As discussed above, so-called Pandrol clips have been developed for reliably securing rails in a direct fixation system while reducing the maintenance and replacement costs associated with prior art devices. The Pandrol clip is a resilient length of steel bar which is bent or formed with a number of continguous straight and curved bearing sections, as discussed in detail in U.S. Pat. No. 3,910,493. For assembly with the fastener 29 of the present invention, a straight section 57 of the Pandrol clip 31 is inserted between the curved section 43 in upper leg 35 and top plate 17. A first bearing section 61 of Pandrol clip 31 engages and securely holds rail 27 in place, and a second bearing section 63 contacts the upper leg 35 of fastener 29 forcing the teeth 45 into engagement with plate serrations 55.

The Pandrol clip 31, or any resilient rail clip of similar configuration, is thus securely held to both the rail 27 and base assembly 11 by the fastener 29 of the present invention. As is apparent, there are no nut and bolt connections at either the point of attachment to the rail 27 or at the anchorage points, and no threads are exposed to the weather which can create the maintenance problems discussed above. Moreover, the lateral position of rail 27 may be readily adjusted relative to base assembly 11 by using a crowbar or similar tool to urge legs 35 and 37 apart and then striking upper leg 35 to move fastener 29 along slot 53 in top plate 17 to the desired position. Another advantage of the present invention is that should the Pandrol clip 31 fail, lateral movement of rail 27 will be independently resisted by fastener 29. The closed generally straight end 41 of fastener 29 abuts against rail 27 and is held in that position by the spring force of legs 35 and 37 acting on top plate 17, in cooperation with the engagement of teeth 45 with plate serrations 55. If the Pandrol clip should fail, the critical spacing between the rail, would be independently maintained by the fastener 29.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means, said fastening means including a pair of generally U-shaped sections of rigid material having an upper and lower leg, said upper leg being formed with a curved portion adjacent the closed end of said U-shape, one of said U-shaped sections being inserted within each of said elongated cut-outs in said top plate on opposite sides of said rail, said U-shaped sections being laterally moveable along said elongated cut-outs to position said closed end in abutment with said rail whereby said anchoring section of each of said rail clips is inserted within said curved portion of said upper leg on each side of said rail to securely hold said rail clips in a position wherein said first bearing section contacts said rail and prevents movement of said rail relative to said base assembly.

2. The rail clip fastening means of claim 1 wherein said closed end of each of said U-shaped sections is formed with a pair of slots corresponding to the thickness of said top plate, said slots engaging said top plate as said U-shaped sections move along said elongated cut-outs of said top plate.

3. The rail clip fastening means of claim 1 wherein said upper and lower legs are spaced apart a distance less than the thickness of said top plate whereby upon insertion of said U-shaped sections within said elongated cut-outs said upper and lower legs are forced apart and bear against said top plate to hold said U-shaped sections laterally in place along said elongated cut-outs independently of said rail clip.

4. The rail clip fastening means of claim 1 wherein the underside of each of said upper legs includes a plurality of teeth and said top plate includes a plurality of correspondingly-shaped serrations formed on opposite sides of said rail to engage said teeth upon insertion of said U-shaped sections within said elongated cut-outs, said teeth and serrations engaging to resist lateral movement of said U-shaped sections relative to said top plate.

5. The rail clip fastening means of claim 1 wherein said U-shaped sections are formed of spring steel.

6. The rail clip fastening means of claim 1 wherein said closed end of each of said U-shaped sections is formed with a pair of slots corresponding to the thickness of said top plate, said slots engaging said top plate as said U-shaped sections move along said elongated cut-outs of said top plate.

7. The rail clip fastening means of claim 1 wherein the underside of each of said upper legs includes a plurality of teeth and said top plate includes a plurality of correspondingly-shaped serrations formed on opposite sides of said rail to engage said teeth upon insertion of said U-shaped sections within said elongated cut-outs, said teeth and serrations engaging to resist lateral movement of said U-shaped sections relative to said top plate.

8. The rail clip fastening means of claim 1 wherein said U-shaped sections are formed of spring steel.

9. In a base assembly for removeably mounting a rail on a support structure, said base assembly including a layer of resilient elastomer material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having an elongated cut-out on opposite sides of said rail, the improvement comprising laterally adjustable rail clip fastening means, said fastening means including a pair of generally U-shaped sections of rigid material having an upper and lower leg, said upper leg being formed with a curved portion adjacent the closed end of said U-shape, one of said U-shaped sections being inserted within each of said elongated cut-outs in said top plate on opposite sides of said rail, said upper and lower legs being spaced apart a distance less than the thickness of said top plate and being forced apart upon insertion of said U-shaped sections within said elongated cut-outs to bear against said top plate, said U-shaped sections being laterally moveable along said elongated cut-outs to position said closed end in abutment with said rail, said upper and lower legs independently holding said U-shaped sections in abutment with said rail, whereby said anchoring section of each of said rail clips is inserted within said curved portion of said upper leg on each side of said rail to securely hold said rail clips in a position wherein said first bearing section contacts said rail and in cooperation with said U-shaped sections prevents movement of said rail relative to said base assembly.

* * * * *